United States Patent [19]

Auge

[11] Patent Number: 4,974,527

[45] Date of Patent: Dec. 4, 1990

[54] MOBILE INCINERATOR SYSTEM FOR LOW LEVEL RADIOACTIVE SOLID WASTE

[75] Inventor: Antonio R. Auge, Tarrogona, Spain

[73] Assignee: Tecnicas Especiales De Reduccion, S.A., Tarragona, Spain

[21] Appl. No.: 468,475

[22] Filed: Jan. 22, 1990

[30] Foreign Application Priority Data

Sep. 14, 1987 [ES] Spain ..... 8701651

[51] Int. Cl.[5] ..... F23B 5/00

[52] U.S. Cl. ..... 110/210; 110/214; 110/216; 110/246

[58] Field of Search ..... 110/210, 211, 214, 216, 110/246

[56] References Cited

U.S. PATENT DOCUMENTS

| | | | |
|---|---|---|---|
| 3,267,890 | 8/1966 | Zinn et al. | 110/214 |
| 3,668,833 | 6/1972 | Cahill, Jr. | 110/210 |
| 3,707,129 | 12/1972 | Kawashimo et al. | 110/246 |
| 4,018,568 | 4/1977 | Brewer | 110/210 |
| 4,089,088 | 5/1978 | Konczalski | 110/210 |
| 4,245,571 | 1/1981 | Przewalski | 110/216 |
| 4,526,760 | 7/1985 | Empie, Jr. | 110/210 |
| 4,676,177 | 6/1987 | Engstrom | 110/210 |
| 4,751,887 | 6/1988 | Terry et al. | 110/216 |

*Primary Examiner*—Henry C. Yuen
*Attorney, Agent, or Firm*—Ladas & Parry

[57] ABSTRACT

Mobile incinerating system for low level radioactive solid wastes, consisting of an installation mounted on a mobile platform and consisting of a rotating combustion chamber into which the wastes to be incinerated are to be inserted from a feeder equipped with a loader. The rotating chamber communicates with a post-combustion chamber. Between these two chambers there is a third gas transit chamber from which the ashes produced drop into a lower collector after having passed a tray fitted with two alternately operating gates. Downstream of the chambers there is a first dilutor followed by a heat exchanger associated with fans. Immediately downstream of the heat exchanger is a decanter followed by a second dilutor from which the gas mixture passes through filters. The level of activity of the gases is controlled by means of a monitor located downstream of the filter.

12 Claims, 1 Drawing Sheet

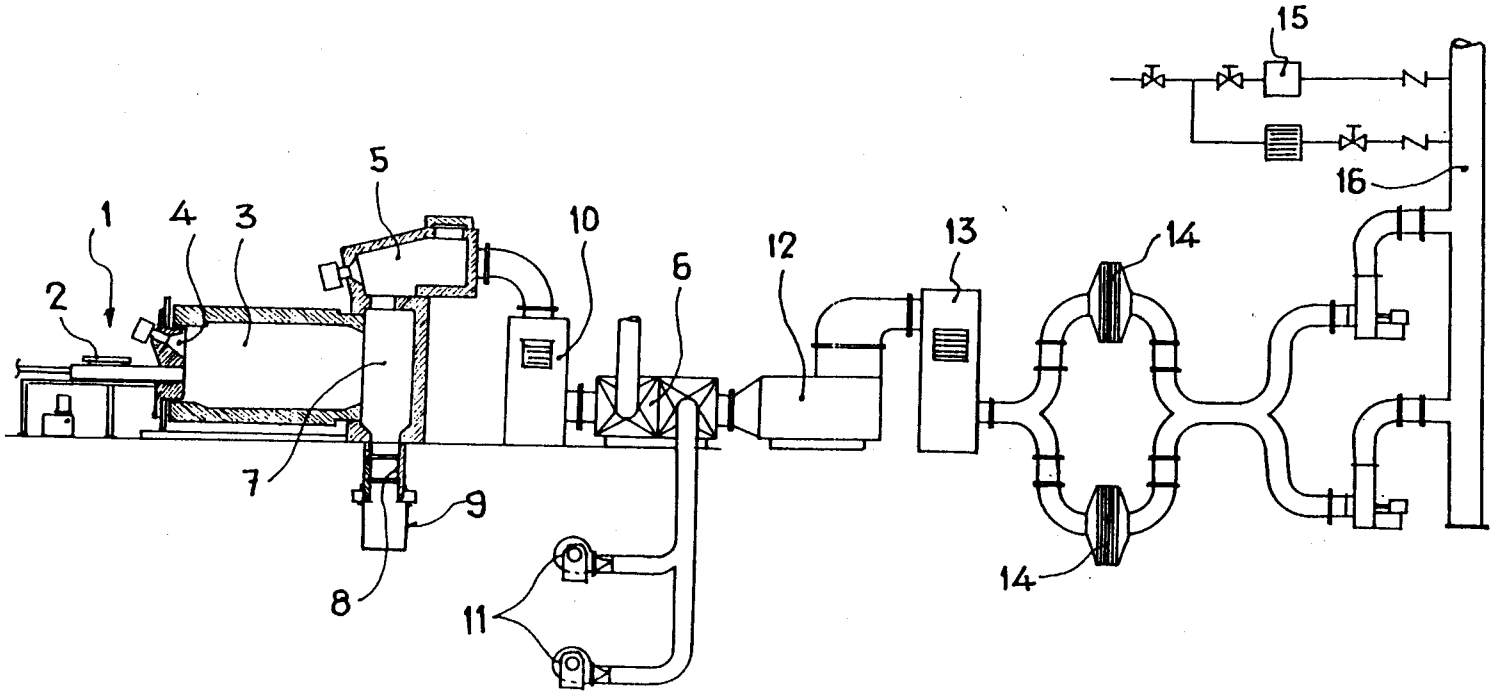
1
2
3
4
5
6
7
8
9
10
11
12
13
14
14
15
16

MOBILE INCINERATOR SYSTEM FOR LOW LEVEL RADIOACTIVE SOLID WASTE

CROSS REFERENCE TO RELATED APPLICATION

This is a Continuation-In-Part of U.S. Ser. No. 241,495 filed on Sept. 7, 1988, now abandoned.

BACKGROUND OF THE INVENTION

The present invention is a mobile incinerator system for disposal of low level radioactive solid wastes, both radiological and other conventional aspects having been contemplated. The present invention attempts to reduce low level radioactive solid wastes by means of a process of pyrolytic incineration. U.S. Pat. No. 3,267,890 to Zinn discloses a traditional nonportable fixed incineration system which is not adapted for radioactive wastes. In the Zinn system, the wastes are not hermetically sealed before transferring them into a combustion chamber. Further, the second combustion chamber of the Zinn reference spews out its contents directly to another chamber which is ducted through a gas duct into a cyclone collector. No gas-air heat exchanger is used to reduce the temperature of this waste and to recycle the heat into the original combustion chambers. Zinn uses a double cyclone system to remove particles. This system is not an efficient small particle separator but is entirely appropriate for urban waste disposal since particles of large sizes are generated in the combustion of urban wastes. However, in disposing of radioactive wastes, filters designed to retain particles less than 0.3 micra are needed and this sort of filter is not used in Zinn. Further, in the disposal of nuclear wastes, a wash and chemical neutralization system must be provided for the gases. Zinn discloses no such system but makes use of water merely to reduce temperature of the operating system.

U.S. Pat. No. 4,018,568 to Brewer also discloses a waste disposal system. However, this system is for sewage disposal and not for disposal of radioactive materials. Because of this fact, the Brewer system fails to hermetically seal the waste, and fails to disclose separate venting and neutralizing systems. Brewer instead discloses a catalytic treatment system for gases which is not adequate for radioactive wastes. It is, however, applicable for gases that originate in fermentations, digesters, or incineration at low temperature. Further, the Brewer reference discloses and emphasizes catalytic recombination. This, too, is not necessary in radioactive waste disposal since once carbon dioxide is filtered, it can be emptied into the atmosphere without concern for odor.

The present invention discloses a device specifically for the disposal of radioactive wastes. The invention is mobile and includes a furnace with a rotary combustion chamber having a custom shape that unloads ashes continuously rather than allowing them to sit and compact. Ashes in the present invention pass through the chamber at a constant rate, the rate depending upon the rotary velocity of the chamber. This is an important aspect of the present invention since most prior art devices make use of static burners. Static burners result in the ashes being compacted since they sit in the combustion chambers for long periods of time. The chamber then becomes the holder of hot burning ashes and becomes embedded with calcium and ash. If radioactive wastes were passed through these chambers, the chambers could not later be decontaminated, transported or reused for other uses since the waste would have to some degree embedded itself in the chambers.

A further aspect of the present invention is that the combustion gases pass from the rotary combustion chamber into an expansion chamber and subsequently into a post-combustion chamber where they are oxidized. Thereafter the gases pass into a dilutor and subsequently into a heat exchanger where they are cooled by gas-air tubes refrigerated by venting circuit.

The present invention is mobile and mounted on platforms for easy transportation from location to location.

The present invention can incinerate low level radioactive solid wastes including wood-plastic having a calorific value lower than 4,631 kcal/kg; plastified paper having a calorific value lower than 4,037 kcal/kg; activated carbon with a calorific value lower than 5,500 kcal/kg; textile materials with a calorific value of less than 3,597 kcal/kg; and resins.

Given that the production of incinerable low level wastes increases significantly during plant shutdowns for refueling, optimum use of the present system will be during such outages in order to avoid significant increases of the number of drums containing low level incinerable materials.

The system described herein allows reductions in volume of wastes of a proportion of 1/60 to 1/70.

SUMMARY OF THE INVENTION

Disclosed herein is a mobile incinerating system for low level radioactive solid wastes which is mounted on a platform to permit transportation from one site to another. The system is designed to carry out the process of pyrolytic incineration of low level radioactive solid wastes in order to achieve a considerable reduction i volume of such wastes. It is essentially characterized by having an initial feeder equipped with a loader in which the wastes to be incinerated are inserted, the loader being in turn fitted with means for hermetic closure and hydraulic equipment designed to insert the waste into a rotating combustion chamber equipped with a burner and chopper gate, the gate being capable of upward and downward movement. The gases produced in this rotating chamber are channeled to a second post-combustion chamber in which a large part of the non-burned volatile materials are eliminated. A third gas passage chamber is located between the rotating combustion and post-combustion chambers for the collection and decanting of ash and inert materials. Beneath the gas passage chamber is an automatic oleohydraulic driven ash-collection tray fitted with two alternate opening enclosure gates through which the ash and inert materials pass through to a collector. Downstream of the chambers is an initial dilutor in which the gases are mixed with atmospheric air, such that at the outlet of the dilutor there is a gas-air heat exchanger designed to reduce the temperature of the air by means of a fan which introduces atmospheric air. A second dilutor is installed along with a neutralizer/decanter located between the heat exchanger and the second dilutor. The gas mixture passes from the dilutor to filtration units, controlled by control elements. In this invention, the combustion and post-combustion chambers receive hot combusted air from the heat exchanger, the temperature being maintained practically constant as a result of a detector located at the outlet of the first dilutor. The signal from this detector actuates the dilutor gate. The decanter/neutralizer of the present invention is located between the heat exchanger and the second dilutor and constitutes a dust and ash neutralizer such that dust and ash are transferred from the decanter to the combustion chambers. The second dilutor is equipped with a servo-driven gate which is actuated by a signal coming from a detector located at its outlet. The control devices of the present invention include an activity monitor, having two actuation signals designed t avoid permissible limits of activity being exceeded. In the case of these limits being exceeded, alarms are generated.

BRIEF DESCRIPTION OF THE DRAWINGS

Attached hereto is a drawing setting forth a diagrammatic view of a preferred embodiment of the invention.

DESCRIPTION OF PREFERRED EMBODIMENT OF THE INVENTION

The present invention is shown assembled and operates in a linear fashion. At the left-most end of the drawing is a feeder (1) connected to an automatic loading device (2). At the right-most end of the drawing, that is furthest downstream from feeder (1), are emission stacks (16). Disposal of radioactive waste begins at feeder (1) and ends at emission stacks (16).

Installation of the present invention begins at the loading station with externally mounted feeder (1) in which the waste materials to be incinerated are inserted in plastic or paper bags weighing approximately 8 kilograms. This feeder (1) is equipped with and leads into a first loading chamber containing an automatic loading device or loader (2) into which the wastes are inserted and held totally isolated from the corresponding rotating combustion chamber (3) attached at one end to loader (2). The wastes are held in isolation in the loading chamber until they are introduced into rotating combustion chamber (3). Access to the interior of rotating combustion chamber (3) is through an opening held normally closed by a chopper gate. The chopper gate is operated by an electric pulsar which acts on an oleohydraulic cylinder automatically driving the gate. The pulsar is placed in strategic locations to control the stroke start and end of the displacement elements, which are the chopper-gate and a hydraulic piston waste-pushing system described below.

The chopper gate operates vertically, that is it may move both upwardly and downwardly. Its movement is synchronized with and driven by the above-noted hydraulic piston. The chopper gate isolates the loading chamber from the rotating combustion chamber (3). Opening of the chopper gate is synchronized so that as it opens, the piston pushes therethrough the radioactive wastes to be burned. By means of electric control elements known in the art, (stroke and pushbutton switch), the closure of the rotating combustion chamber (3) takes place automatically once the pushing cycle has been performed. The loading chamber is airtight, no exhaust of combustion through the gates to the exterior being possible due to the synchronized automatic opening and closure of the gates. Further, it is airtight because it is under a negative pressure to confine any air within it.

To reiterate the foregoing, after inserting the waste into the loader (2), a pushbutton is moved into a closed position until total hermetic closure of the waste within the loader is achieved. Following hermetic closure of the wastes, the piston pushes the packaged waste toward the chopper gate and thus toward the inside of rotating combustion chamber (3). Simultaneous with this pushing movement, the chopper gate is lifted to permit access to the inside of rotating combustion chamber (3). The hydraulic piston produces a translation motion which gives rise to the entrainment of the waste bags within the combustion chamber. Upon completion of the cycle, the piston is withdrawn and the chopper gate is lowered to its original position thus isolating the inside of the rotating combustion chamber (3) from the loading area where loader (2) and feeder (1) ar located.

The wastes are inserted regularly into rotating combustion chamber (3). In rotating combustion chamber (3) a combustion phase occurs in a reducing atmosphere, this producing technical pyrolysis of the wastes and distillation of high combustion power gases. Feeding of the wastes will be interrupted when the temperature of the rotating combustion chamber (3) reaches its maximum permissible temperature which is approximately 800 to 900 degrees centigrade.

The feeder (1) is controlled such that it does not receive more than the rotating combustion chamber can properly heat. For this purpose, there exists an electronic thermopar device to block feeder (1) automatically in case the inner temperature of the rotating combustion chamber (3) exceeds the set limit. Thus, the chopper gate system and the waste-pushing system would be stopped until the appropriate temperature is achieved.

The rotating combustion chamber (3) is equipped with an auxiliary combustion burner (4) shown in the drawings to be located above the loader (2) and feeder (1). The auxiliary combustion burner (4) is connected to rotating combustion chamber (3). When the system's working temperature, which is approximately 600 degrees centigrade, is reached, the auxiliary combustion burner (4) is automatically stopped.

Connected at a second end of rotating combustion chamber (3), opposite the one end where connection of the feeder (1) and loader (2) exists, is gas passage chamber (7). As shown in the drawing, rotating combustion chamber (3) has a major horizontal axis extending from the feeder/loader connection to the gas passage chamber connection. Gas passage chamber (7) has a major vertical axis which is generally perpendicular to the major horizontal axis of the rotating combustion chamber (3) and defines at one end the top of gas passage chamber (7) and at the other end the bottom. At the top of gas passage chamber (7) is post combustion chamber (5). At the bottom of gas passage chamber (7) is ash collecting tray (8) which itself is attached to ash collector and cooler (9). Thus ash collecting tray (8) lies between ash collector and cooler (9) and gas passage chamber (7).

The gas passage chamber (7) located between the rotating combustion chamber (3) and the post-combustion chamber (5) is for the removal and decanting of ash and inert materials. The slag material decanted by gravity drops into an automatic ash-collecting tray (8) which is oleohydraulically driven and fitted with two opening-closure gates which operate alternately in order to empty the tray on a timed basis into a collector (9). This collector automatically closes when the previously established level is reached. In the collector (9), the ashes are cooled in order to allow subsequent drumming.

The gases produced in the rotating combustion chamber (3) are channelled through gas passage chamber (7) to second post-combustion chamber (5). Here a thermal reaction takes place in an oxidizing atmosphere, thus eliminating a large part of the volatile materials not burned by combustion and inert materials arising through the settling process that occurs due to the reduction in a gas-flow speed.

As shown in the drawing, post combustion chamber (5) is in communication with gas passage chamber (7) at a first leftmost end and at a second rightmost end is connected to and in communication with a metallic chamber or dilutor (10). The gases in post combustion chamber (5) pass to dilutor (10) to be cooled by mixing with atmospheric air.

Dilutor (10) is shown to have a similar shape to that of gas passage chamber (7), dilutor (10) lying downstream of gas passage chamber (7) and separated therefrom by its top side connection with post combustion chamber (5). Downstream from dilutor (10) is gas-air heat exchanger (6) which connects to dilutor (10).

As stated, the gases passing through dilutor (10) are mixed with atmospheric air entering through a servo-driven gate. This gate is operated by means of a signal generated by detector located at the dilutor outlet. This signal assures a constant temperature of 900 to 1,000 degrees centigrade in the heat exchanger (6).

The outlet of the dilutor, or dilution chamber (10), connects with gas-air heat exchanger (6). Gas-air heat exchanger is designed to reduce the temperature of the gases in dilutor 10. A fan (11) connected to gas-air heat exchanger (6) sucks in atmospheric air to gas-air heat exchanger (6) to cool the gases in dilutor (10) achieving a reduction in temperature of 250 to 300 degrees centigrade. The hot air from the gas-air heat exchanger (6) is used as combustion air for injection into the combustion chambers, excess air being expelled from the system.

Following the gas temperature reduction process in dilutor (10) and gas-air heat exchanger (6), the gases are neutralized in decanter/neutralizer (12). Decanter/-Neutralizer (12) is connected to gas-air heat exchanger (6) downstream from the dilutor (10) gas-air heat exchanger (6) connection. As the gas passes from gas-air heat exchanger (6) into decanter/neutralizer (12), a controlled liquid solution is sprayed thereover.

Decanter/Neutralizer (12) is made up of a cylindrical body and contains water diluted with caustic soda. In the mouth of the combustion gas inlet, is a venturi irrigation mouth which provides a spray of water which is mixed with the combustion gases to decant the solid particles which might appear. These particles then are introduced into the reservoir bed where they precipitate at the bottom and are subsequently absorbed again and passed onto the first combustion stage to be further incinerated. Thus, a recycling process is constantly ongoing.

As shown in the drawing, decanter/neutralizer (12) has a vertical column which connects decanter/neutralizer (12) to another dilutor (13) located to its left. The column is comprised of a plurality of metal rings where gases already washed in decanter/neutralizer (12), rise upwardly through these rings and are sprayed at least twice by the water diluted with caustic soda mentioned earlier with respect to the spraying of the gases in the decanter/neutralizer (12). This gives rise to a new decantation of particles and neutralizing of the pH of the gases until a pH level of 6 or 7 is achieved.

In order to assure that the temperature of the gases passing from decanter/neutralizer (12) is adequate, the gases after passing through the rings in the vertical column discussed above, are channeled into second metallic chamber or dilutor (13). As in dilutor (10) the gases again are mixed with outside air until a certain temperature level is reached. Outside air is introduced into dilutor (13) by means of a servo-driven gate which is operated by means of a signal from a detector located at the outlet of the dilutor.

As a general discussion of dilutors (10) and (13) of the invention, both absorb atmospheric air and introduce this air to lower the temperature of the mixture of clean air combustion gases. The atmospheric air is brought in through the servo-driven gates which are automatically operated by thermostats adjusted at stabilized differential temperature. The dilutors (10) and (13) are rectangular reservoirs coated by refractory cement and define within a labyrinth to homogenize the air introduced therein with the combustion gases. In the invention, dilutor (10) operates under a high temperature regulating the maximum temperature to 1100 degrees centigrade. Dilutor (13) operates in the same way but controls the temperature so that it does not exceed 200 degrees centigrade.

Following dilution of the gases in dilutor (13), the resulting mixture is filtered through two series-mounted HEPA filters (14) with a degree of efficiency per filter of 99.9% for particles of 0.4 micra. The HEPA filters (14) are connected to the outlet of the dilutor (13) and downstream thereof so that they are connected generally opposite of the decanter/neutralizer (12).

The gases having been filtered, they are then channeled through further piping for control of the level of activity. In this respect, an activity monitor (15) is used which provides two actuation signals assuring that the appropriate gaseous effluent permissible activity limits are not exceeded at any time. If the concentration of activity emitted were to reach a set limit, the monitor alarm would trip and shut down the system.

As the last stage, the gases are extracted by means of a centrifugal fan which takes the gases resulting from the incineration process and channels them towards the emission stacks (16).

The installation described herein is mounted on a mobile platform which can be transported at any time to whatever location might be desired or required, this making it possible, for example, for certain companies or factories to avoid the need for a fixed, permanent installation for purely periodical and sporadic use.

The system control components are as follows.

(a) Temperature: Both the combustion chamber (3) and the post-combustion chamber (5) are equipped with a twin setpoint thermocouple detector designed such that the first setpoint automatically shuts down the burners and the second blocks the feed system (1).

In order to control the temperature of the smoke at the inlet to the HEPA filters (14), a detector is installed which acts on a proportional servo-motor designed to open or close the dilutor (13) air inlet gate, thus maintaining the temperature constant.

(b) Dirty filters: These are controlled by means of a pressurestat which generates a signal when the gas pressure through the filters decreases. This actuates optical and acoustic alarms and thus indicates the need to change the filters. Meanwhile, the system is bypassed to standby filters.

(c) Activity of emitted smoke: The activity detector (15) makes it possible to control the concentration of activity and total activity of the smoke that is released. This detector (15) has two setpoints. An initial pre-alarm signal acts on a number of elements. The first is shutdown of the rotating combustion chamber (3) and auxiliary burner (4). The second is shutdown of the chamber drive system and automatic closure of the combustion air dumper. The third is blocking of the waste loading system. When the level of activity reduces to the correct limits, all of the foregoing elements are automatically reactivated and the installation is ready for new loads. If, in spite of the pre-alarm actuation, the level of contamination increases, the alarm is generated and shuts down the post-combustion burner (5) and closure of the compressed-air dumper. Further, the dumper is opened to permit hot air to be extracted. Additionally, the combustion chambers air inlet gates are opened. Once the levels of contamination reach their permitted values, the installation or system self-regulates and comes into service automatically or manually.

The control elements are conventional elements known in the art.

In summary, the system is comprised of a rotating combustion chamber (3) in which the wastes are inserted from an externally mounted independent feeder (1) where they are fed into plastic bags. The rotating combustion chamber (3) communicates with the second, post-combustion chamber (5) wherein thermal reaction with the gases fed in from the rotating combustion chamber (3) occurs. This eliminates a large part of the volatile materials not burned by combustion or decanted inert materials. Combustible hot air is injected into both chambers from the gas-air heat exchanger (6) located downstream of chambers (3, 5). A third gas passage chamber (7) is located between the two described chambers (3, 5) in order to permit the removal and decanting of ashes and inert materials. Downstream of the post-combustion chamber (5) is a dilutor (10). Dilutor (10) connects at its outlet to heat exchanger (6). At that junction is a detector designed to assure a relatively constant temperature in the heat exchanger. The heat exchanger (6) is fed with atmospheric air by means of at least one fan (11), this air being used to cool the gases passing therethrough. Hot air from the heat exchanger is injected into the combustion chamber (3,5) with excess air being expelled from the system.

Further downstream in the system is the above-mentioned dust and ash decanter/neutralizer (12). Here dust and ash are removed from the gas and rechanneled to the combustion chambers. The second dilutor (13), located downstream of the decanter/neutralizer (12) is used to mix the gases with atmospheric air in order to achieve an adequate temperature for the gases as they pass through filtration stage (14). Immediately downstream of the filters (14) is a gas-activity control stage in which detector (15) having two actuation signals is connected. These signals are designed to prevent excesses in the permissible gaseous effluent activity limit.

Applicant claims the present invention as follows:

1. A mobile incinerating system for low level radioactive waste comprised of:

an automatic, hermetically sealable feeder for hermetically sealing said waste and feeding said waste into said system;

a first combustion chamber communicating with but isolated from said feeder, said combustion chamber acting to distil the high combustion power gases resulting from the combustion of said waste fed into it by said feeder as well as to pyrolize the waste.

a second combustion chamber having an oxidizing atmosphere for treating the contents emitted from said first combustion chamber;

a gas passage chamber serially connected between said combustion chambers, said gas passage chamber acting to remove and decant ash and inert materials from the contents emitted from said first combustion chamber prior to passing said contents to said second combustion chamber;

a dilutor serially connected to said second combustion chamber to mix the contents emitted from said second combustion chamber with outside atmosphere;

a gas air heat exchanger attached to said dilutor, said gas-air heat exchanger acting to reduce the temperature of the contents emitted from said dilutor to said gas-air heat exchanger, hot air from said gas-air heat exchanger being channeled back into said first and second combustion chambers;

a neutralizing chamber attached to said gas-air heat exchanger, said neutralizing chamber expelling a neutralizing liquid over the contents expelled from said gas-air heat exchanger into said neutralizing chamber, the neutralized elements being transferred back to said combustion chambers for removal by means of said gas passage chamber, the non neutralized elements being expelled;

a second dilutor connected to said neutralizing chamber for receiving said non-neutralized elements expelled from said neutralizing chamber, said dilutor mixing its contents with atmospheric air;

HEPA filtering means attached to said second dilutor and receiving contents from said second dilutor to filter and expel, said filtering means having a 99.9% efficiency for particles of 0.4 micra; and a system monitor associated with said filter to monitor the amount of gaseous effluent in the contents expelled from said filtering means and to stop the entire system if said effluent exceeds a prescribed limit.

2. The system of claim 1 further comprising means to detect the temperature in said first combustion chamber and to control said feeder, the operation of said feeder being automatically interrupted when the temperature in said first chamber reaches about 800 degrees centigrade.

3. The system of claim 2 further comprising a servo-driven gate attached to an outlet area of said dilutor and operating to provide outside air to said dilutor, said servo-driven gate operating to ensure that the temperature of said gas air heat exchanger is maintained at about 900 degrees centigrade.

4. The system of claim 14 further comprising a gate associated with said first combustion chamber;

an oleohydraulic cylinder which drives said gate; and an electric pulsar which acts on said oleohydraulic cylinder such that after inserting the waste into the feeder, the waste is pushed toward said first combustion chamber while said gate is lifted to accept said waste, the gate then closing upon receipt of said waste in said chamber.

5. The system of claim 4 further comprising an auxiliary combustion burner attached to said first combustion chamber and operable until the temperature in said first combustion chamber reaches approximately 600 degrees centigrade.

6. The system of claim 5 further comprising an ash collecting tray connected to said gas passage chamber, said ash collecting tray having two gates which are oleohydraulically driven to operate alternately in order to empty the tray on a timed basis; and a collector attached to said ash collecting tray for receiving the contents of said ash collecting tray and cooling said contents for subsequent dumping.

7. The system of claim 6 wherein at least on fan used to bring in atmospheric air is connected to said gas-air heat exchanger, said fan achieving a reduction in temperature in said gas-air heat exchanger of around 250° C.

8. The system of claim 7 further comprising heating mechanisms associated with said combustion chambers and a twin set point thermocouple detector equipped on said combustion chambers, said twin set point thermocouple detector automatically shutting down heating mechanisms associated with said chambers and blocking said system when said set point is reached.

9. The system of claim 8 further comprising a detector and a servo-motor both associated with said filtering means, the detector controlling the temperature at an inlet area of the filtering means and acting on the proportional servo-motor and an air inlet gate associated with said dilutor to open or close the air inlet gate associated with the dilutor to maintain the temperature within the dilutor.

10. The system of claim 9 further comprising a pressurestat which generates a signal when the pressure in the filters decreases below a certain limit said pressure decrease resulting from the need to clean said filters.

11. The system of claim 10 further comprising a standby filter attached to said dilutor such that upon an indication from said pressurestat that said filters are suffering a pressure decrease, said filters may be closed off and said standby filter placed in use.

12. The system of claim 11 further comprising a detector located at the outlet of the first dilutor, said detector acting to maintain the temperature of the contents coming from said heat exchanger to said combustion chambers.

* * * * *